United States Patent [19]

Pittasch

[11] 4,286,352

[45] Sep. 1, 1981

[54] FURNITURE HINGE

[75] Inventor: Willi Pittasch, Herford, Fed. Rep. of Germany

[73] Assignee: Richard Heinze GmbH & Co. KG, Herford, Fed. Rep. of Germany

[21] Appl. No.: 936,247

[22] Filed: Aug. 24, 1978

[30] Foreign Application Priority Data

Sep. 1, 1977 [DE] Fed. Rep. of Germany ..... 2739417

[51] Int. Cl.[3] ..... E05D 7/04

[52] U.S. Cl. ..... 16/130; 16/147

[58] Field of Search ..... 16/139, 140, 147, 141, 16/144, 129, 130, 137, 132, 175

[56] References Cited

U.S. PATENT DOCUMENTS

| | | | |
|---|---|---|---|
| 3,390,486 | 7/1968 | Walters | 16/147 X |
| 3,952,367 | 4/1976 | Schnelle et al. | 16/147 |

FOREIGN PATENT DOCUMENTS

| | | | |
|---|---|---|---|
| 2357715 | 6/1975 | Fed. Rep. of Germany | 16/131 |
| 1458607 | 9/1965 | France | 16/140 |
| 567542 | 2/1945 | United Kingdom | 16/141 |

*Primary Examiner*—Andrew V. Kundrat

*Attorney, Agent, or Firm*—Thomas R. Morrison

[57] ABSTRACT

The invention relates to a hinge for suspending a door, especially a glass door, on an item of furniture, with a hinge arm fastened on the furniture and a hinge part to be fastened on the door, in which, when the door is closed, this hinge part is situated within a first surface of a second surface of the hinge arm. The invention is characterized by the fact that one of the surfaces has a ratchetting face and the other surface is provided with a spring loaded ratchetting element which snap fits behind this ratchetting surface.

24 Claims, 22 Drawing Figures

(II-II)

(III-III)

(I-I)

(IV-IV)

FURNITURE HINGE

BACKGROUND OF THE INVENTION

The invention relates to a hinge for hinging a door, especially a glass door on an item of furniture with a hinge arm fastened on the furniture and with a hinge part which can be fixed on the door, in which, when the door is closed, the said hinge part rests with a first surface adjacent to a second surface of the hinge arm.

For hinging of glass doors on a piece of furniture, a hinge has been proposed which consists of a hinge part having several wall sections fastened on the glass door enclosing the corner thereof. By enclosing the corner, an especially simple fastening of the hinge part on the glass door is accomplished without need for special bores in the door. The glass door is merely clamped into the hinge part. The hinge part rotates with respect to the furniture on a hinge arm, which can be fastened internally to the furniture body, for example, to the inner faces of a furniture bottom and top or on the inner surface of a furniture side wall. The hinge part is situated at the upper or lower longitudinal edge of the door, and a pivot axis in this region permits the door to swivel.

The objective of the invention is to provide an improved hinge of the above described kind of simple construction, in which a snap action closing or holding effect is achieved. That is, at the end of its closing movement, the door is automatically pushed into the closed position and held there, and can be opened once again only after overcoming a certain force.

SUMMARY OF THE INVENTION

For the solution of this objective a hinge of the above described kind is formed with a ratchet step on one of its surfaces and a spring loaded ratchet element on another of its surfaces. The ratchet element makes a snap connection behind the ratchet step.

The ratchet step may be formed, for example, by a depression or by the edge of a depression. It is, however, also possible to form the ratchet step by providing a projecting head on one of the surfaces which projects above this said surface and behind which snap engagement of the ratchet element on the other surface may take place when the door is closed. The abovementioned bead is in this case preferably designed as a long slender bead and in this case it may be situated across or at right angles to the path along which the ratchet element is moved in opening and closing of the door.

The abovementioned surfaces are preferably formed by regions of the hinge housing or hinge arm which is to be fastened on the door. The regions are arranged at right angles to the hinge swivelling axis.

The hinge according to the invention ensures, in addition to its simple construction, provides the advantage that special snap action or holding elements for the closed position can be eliminated, and the relatively laborious attachment thereof, especially to glass doors, may be eliminated. In addition, since such holding elements would be visible through the glass door, they would disturb the view.

In the hinge according to the invention it is possible to fit elements on the hinge parts which generate holding or closing action without attracting attention, i.e. the elements are hardly visible when the door is closed and opened. The hinge according to the invention has a highly compact construction and it can be made with small dimensions. In the hinge according to the invention the spring loaded ratchet element is preferably a ball loaded by a compression spring, leaf spring or a similarly acting spring element. The ball is for example arranged in an opening or bore of the hinge part and/or the hinge arm. When the ball is arranged in the hinge part the hinge part preferably also includes a bead, which is, for example, arranged so that it projects beyond the inner surface of the door and is situated within the furniture when the door is closed. The bead, which projects preferably in the direction of the hinge swivelling axis has a through bore into which is fitted the ball, the spring force generating spring element and an adjustable contact face, preferably a spring adjusting screw guided in a tapped hole.

According to another embodiment of the invention it is also possible to arrange the ball in a bore of the hinge arm or in a bore in a base or adjusting plate for the hinge arm. In this embodiment the spring effect is generated preferably by a leaf spring, having two webs or flanges which enclose the hinge arm or clamp the base or adjusting plate of the hinge arm in the region of the bore for the ball. At least one of the arms of the leaf spring has another bore through which part of the circumference of the ball projects outwards. The ball is held in place by contact with the other arm of the leaf spring also provided with a hole and is in contact with a surface of the hinge arm or the base or adjusting plate of the hinge arm.

The hinge arm itself is, for example, held on the furniture so that the hinge arm can be adjusted. Such adjustable fastening is made possible either by slots in the hinge arm to accommodate fastening screws, or alternatively by providing at least one-directional adjustability of the hinge arm with respect to one base or adjusting plate.

BRIEF DESCRIPTION OF THE DRAWINGS

The invention is described below in detail with reference to the drawing in which.

DETAILED DESCRIPTION OF THE PREFERRED EMBODIMENT

Figure 1:
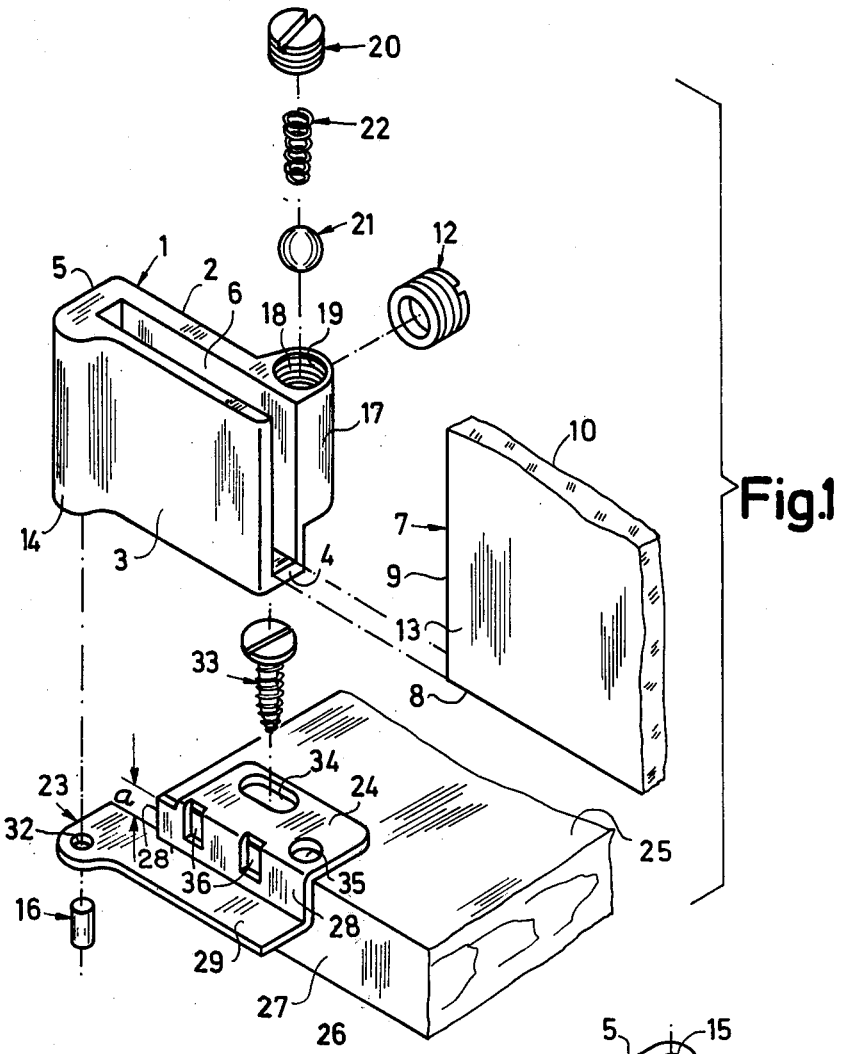
FIG. 1 is an exploded perspective view of the hinge part, hinge arm as well as of the ratchet element fitted on the hinge part and the connecting pivoting axis connecting the hinge part with the hinge arm, together with a partial view of a glass door and furniture bottom.

The hinge shown in FIGS. 1 to 6 consists of a hinge part 1, which consists basically of the two parallel wall sections 2 and 3, which can have a rectangular or square circumferential enclosing surface and which are connected at two adjacent circumferential edges by the wall sections 4 and 5 in such a manner that the wall sections 2 and 3 form a space closed on two circumferential edges and an open space 6 open towards both other circumferential edges, into which a corner of a glass door 7 can be inserted. An edge, (first occurrence), which is at right angles to the swivelling axis of the glass door 7 such as, for example, the lower 8 of glass door 7, is in contact with the inner surface of the wall section 4 and the longitudinal edge 9, running parallel to the swivelling axis of the glass door 7 is in contact with the inner face of the wall section 5.

The wall section 2 adjacent to the inner surface 10 of the glass door has a through tapped hole 11 into which can be screwed a screw, preferably a grubscrew 12, whose point projects into the space 6 into contact with the inner surface 10 of the glass door 7 when the grubscrew 12 is tightened. The outside surface 13 of the glass door 7 is pressed against the inner face of the wall section 3, when the hinge part 1 is firmly connected to the corner of the glass door 7. In the region of the wall section 5 the other wall section 3 is made thicker to form a bead 14 which projects in the direction of the swivelling axis of the hinge, this bead 14 projecting beyond the outside surface of the wall section 3. On the end of the bead 14 adjacent the wall section 4, i.e. at the lower end of the bead 14 in FIG. 1 or the upper end of the bead 14 in FIG. 2, a bore 15 is provided for a single pivot pin 16, which, for example, can be fastened by press fit into the hole 15.

Figure 2:
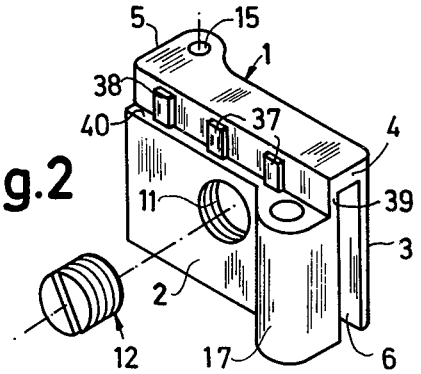
FIG. 2 is a perspective vie of the hinge part of the hinge according to FIG. 1, viewed on the underside not visible in FIG. 1.
Figure 3:
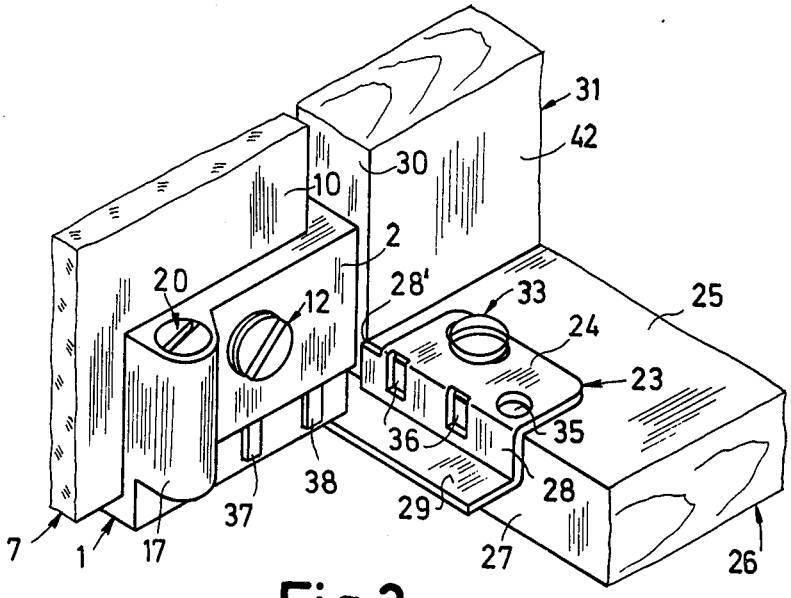
FIG. 3 is a perspective view of the hinge, with the door opened, fitted on the furniture, the furniture bottom or the door.
Figure 4:
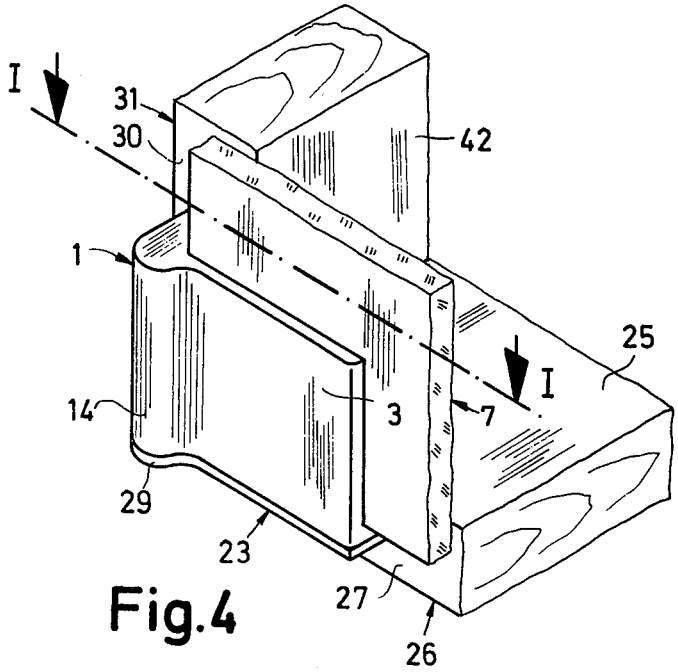
FIG. 4 is a view as in FIG. 3, but with the door closed.
Figure 6:
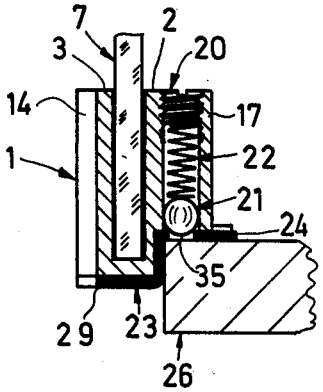
FIG. 6 is a section along line II—II in FIG. 5.
Figure 7:
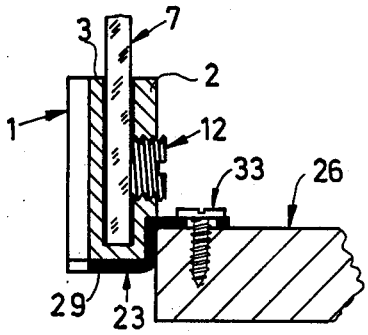
FIG. 7 is a section along the line III—III in FIG. 5.
Figure 5:
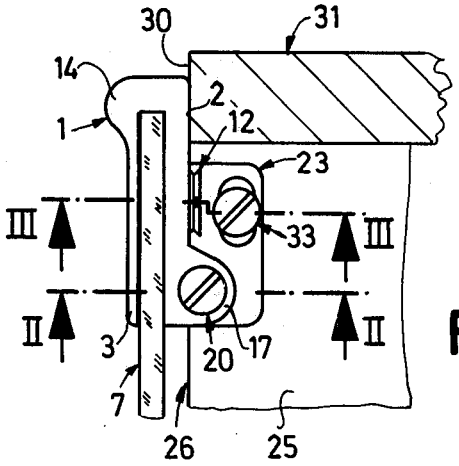
FIG. 5 is a section along ling I—I in FIG. 4.

On the end remote from the bead 14, another bead 17 is provided on the outside surface of the wall section 2, which also projects in the direction of the swivelling axis of the hinge. This bead 17 projects also beyond the outside surface of the wall section 2 which, in contrast to the bead 14, does not project over the whole depth of the hinge part 1. Instead, the lower end of the bead 17 shown in FIG. 1 ends a certain distance from the edge of the hinge part 1 and this edge is determined by the wall section 4. The bead 17 has a through bore 18, which projects in the direction of the swivellilng axis of the hinge 4 in the direction of the longitudinal axis of the pivot pin 16. The through bore 18 has an internal screw thread 19 for a grubscrew 20 at the end of the bead 17 facing away from the wall section 4. From the end of the bore 18 seen in FIG. 1, the dimeter of the bore 18 corresponds to the diameter of a ball 21 used as ratchet element. The diameter of the other end of the bore 18 adjacent the wall section 4, seen in FIG. 2, is narrower than the ball 21. Ball 21 is spring loaded in the bore 18 by a helical compression spring 22 to project partly beyond the smaller diameter of the bore 18 in the bead 17 facing the wall section 4. When the ball 21 is fitted into the hole the compression spring 22 rests with one end against the surface of the ball 18 and its other end rests against the end of the grubscrew 21 which projects into the bore 18.

The hinge arm 23 is used for fastening the hinge on an item of furniture. The hinge arm 23 is preferably a flat component, bent several times to produce its final shape. An angle bracket 24 on hinge arm 23 is screwed to a part of the inner surface of the furniture which is at right angles to the swivelling axis of the hinge. For example angle bracket 24 may be screwed to the inner surface 25 of a furniture floor 26 using a screw 33. On the front end face 27 of the furniture floor 26 a section 28 is connected to the bracket 24. The surfaces of section 28 are disposed parallel to the end face 27 and at right angles to the surfaces of the bracket 24 and joins a similarly flat section 29. Flat section 29 has its surface parallel to the bracket 24 and at right angles to the end face 27 and is arranged in front of end face 27. The flat section 29 which is at right angles to the hinge swivelling axis is, as shown especially in FIGS. 1 and 3, extended sideways beyond the end faces of the furniture floor 26, so that one end of the section 29 is also situated in front of the end face 30 of a furniture side wall 31. At this end a bearing hole 32 for the pivot pin 16 is provided through the section 29. As shown in FIG. 1 the bearing hole 32 is arranged into the region of a rounded projection whose shape matches the shape of the bead 14 and it is arranged into the region of this projection so that the rounded projection forms optically a continuation of the bead 14, while the remaining end edge, remote from the furniture floor 26, of the section 29 forms optically a continuation of the outside surface of the wall section 3, when the glass door 7 is closed, i.e. the width of the section 29 corresponds approximately to the distance which separates the outside surfaces of the wall sectins 2 and 3 from each other.

The hinge arm 23 is fastened on the inner surface 25 of the furniture floor 26 with a fastening screw 33, which passes through a slot 34 in the bracket 24 into the material of the furniture floor 26. The slot 34, which projects in the direction parallel to the end face 27, permits setting or adjustment of the hinge arm 23 at right angles to the hinge swivelling axis as well as parallel to the end face 27 for compensating production tolerances in the furniture or in the hinge.

The bracket 24 includes a depression or bore 35, into which part of the ball 21 projecting beyond the end of head 17 enters by snap action when the glass door 7 is closed. This snap action is made possible by ensuring that the width of the section 28 or the distance between the visible surface of the bracket 24 as seen in FIG. 1 is equal to the distance a also from the equally visible upper surface of the section 29. In order to ensure a positive locating type connection effect, after the ball 21 snaps into the hole 35, two rectangular openings 36 are provided between the hinge part 1 and the hinge arm 23 in the section 28 between the bore 35 and the end of the section 29 with the bore 32. Two rectangular openings 36 are parallel to the direction of the swivelling axis of the hinge and project by amount equal to the thickness of the section 28 into the bracket 24. The projections 37 match rectangular openings 36 and are arranged on the outside surfaces of the wall section 2 which face inwards towards the furniture when the glass door 7 is closed. A further projection 38 is situated, when the glass door 7 is closed, laterally against the end face 28', adjacent to the hole 32, of the section 28. The projections 37 and 38 are formed so that the wall section 2 has along its edge adjacent to the wall section 4 a step or a region 39 of reduced thickness and this said region has a width corresponding to the distance a, in which the projections 37 and 38 are formed as raised parts projecting from the wall section 2. The region 39 also ensures that the side edges 40, remote from the wall section 4, of this region are in contact with the upper face of the bracket 24 when the glass door 7 is closed, which results in an additional connection or guiding effect between the ginge part 1 and the hinge arm 23 when the glass door 7 is closed or this effect is ensured at the end of the door closing movement. The guiding effect ensured by the opening 36, as well as the projections 37 and 38 and the side edge 40, between the hinge part 1 and the hinge arm 23 is used, on the one hand, for relieving the section 29 from turning moments when the glass door 7 is closed and simultaneously also for corresponding relieving of the turning moments, which could be exerted at ball 21 and spring 22.

Figure 8:
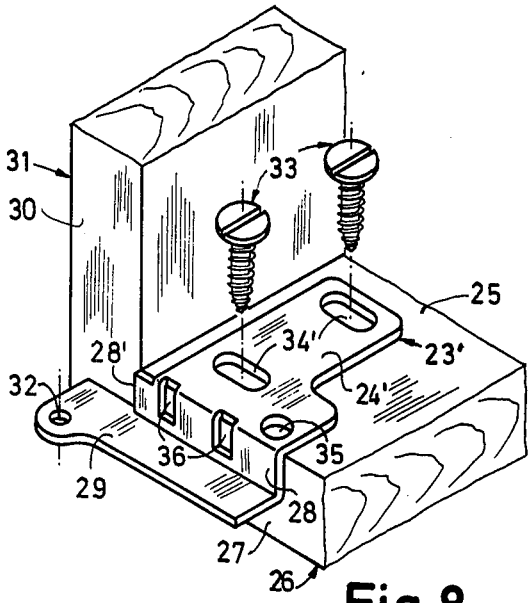
FIGS. 8 and 9 show a perspective view, together with a partial view of the furniture, of other embodiments of the hinge arm for use with the hinge according to FIG. 1.

The basic difference between the hinge arm 23' shown in FIG. 8 and the hinge arm 23 is that the hinge arm 23' is extended towards the furniture inner part and it has in the region of this extension a second slot 34' for a second fastening screw 33. The hinger arm 23' is held against twisting by ensuring that this hinge arm, with its section 28 and its bracket 24, encloses the front edge of the furniture floor 26 whih is also the case with the hinge arm 23.

Figure 9:
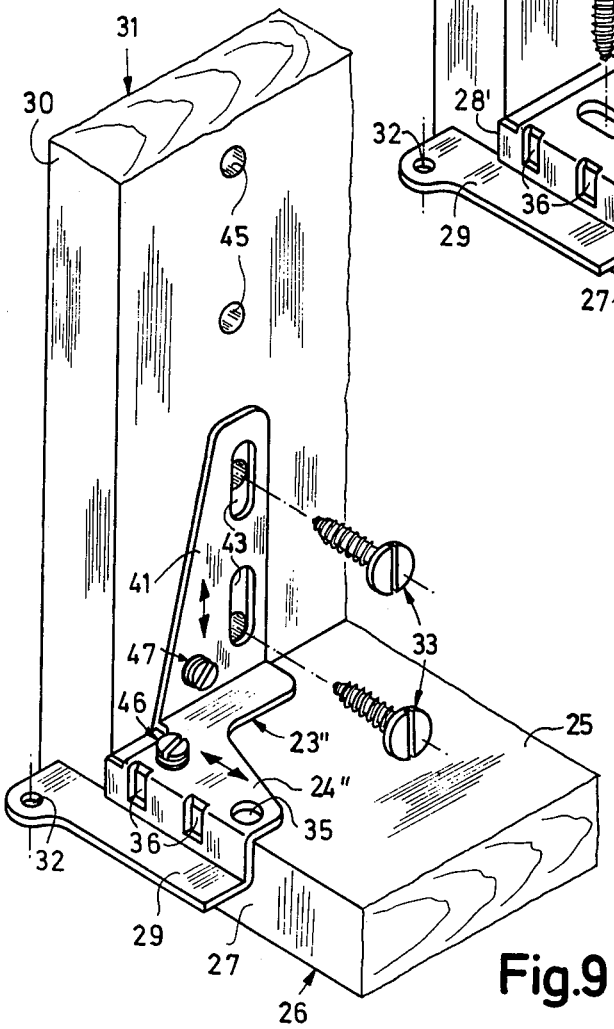

FIG. 9 shows a hinge arm 23'' whose bracket 24'', which is parallel to the inner surface 25 of the furnitur floor 26, has a bent part 41 which is situated parallel to the inner surface 42 of the furniture side wall 31 and which has, in the direction of the hinge swiveling axis two series arranged slots 43 for fastening screws 33, which engage in the shown embodiment, in prepared bores 45 of the bore row provided on the inner surface 42. The slots 43 ensure adjustment of the hinge arm 23'' in the direction parallel to the inner surface 42, i.e. in the direction of the hinge swivel axis, on actuation of the adjusting screw 46 provided in the bracket 24'', which adjusting screw with its lower end, not visible in FIG. 9, is in contact with the inner surface of the furniture floor 26. Moreover, it is also possible to adjust the hinge arm 23'' in a direction at right angles to the hinge swivel axis and parallel to the end face 27 by means of the adjusting screw 47 provided at the bent part 41 and this adjusting screw 47 is in contact by its point, not visible in FIG. 9, with the inner surface 42 of the furniture side wall 31.

Figure 10:
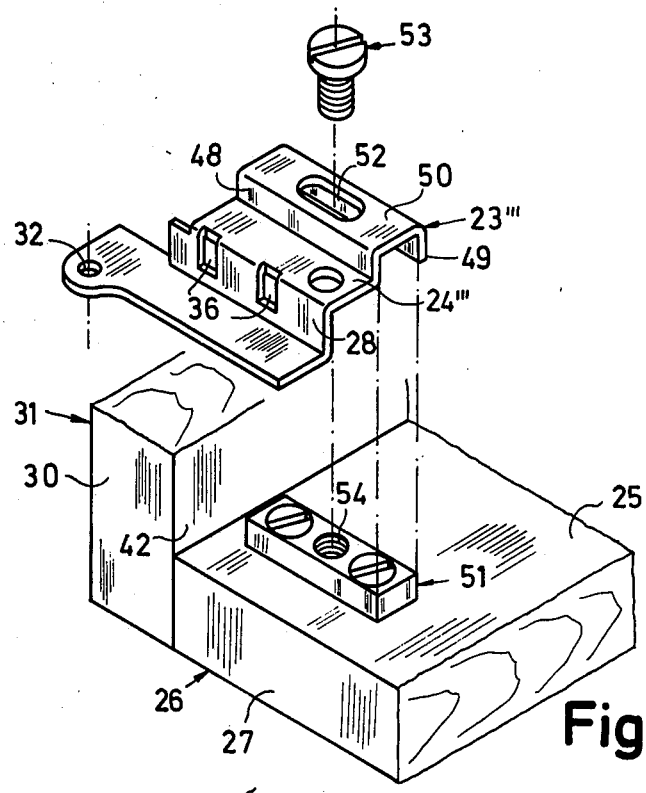
FIG. 10 is a perspective view of another embodiment of the hinge arm with a base or adjusting plate for the hinge arm together with a partial view of the furniture with the hinge arm removed from the base or adjusting plate.
Figure 11:
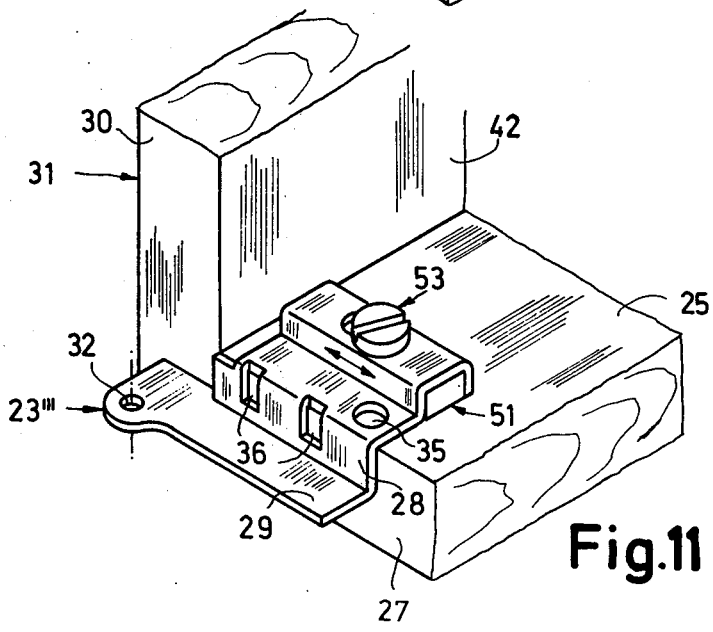
FIG. 11 is a view as in FIG. 10, but with a hinge arm installed on the base or adjusting plate.

FIGS. 10 and 11 show a hinge arm 23''' in which the end facing away from the section 29 has a U profile, i.e. this end has two flanges 48 and 49 which project in the direction of the edge 27 of the furniture floor 26, these flanges 48 and 49 are connected by a yoke 50 to form a U profile which is open towards the underside of the bracket 24'''. When the hinge arm 23''' is installed the flanges 48 and 49 grip an adjusting plate 51 of rectangular shape, so that no rotation is possible and the adjusting plate is situated with its longitudinal edges parallel to the edge 27 and is fastened on the inner surface 25 of the furniture floor 26 by screws. A fastening screw 53 which passes through a slot 52 in the yoke 50 is held in a tapped hole 54 in the adjusting plate 51. As shown especially in FIG. 11, the hinge arm 23''' can be pushed along or adjusted, with slightly loosened fastening screw 53, on the adjusting plate 51 in the direction of the double arrow.

FIGS. 12–19 show an embodiment of the hinge according to the invention with a hinge part 1', whose design is very similar to that of the hinge part 1 in FIGS. 1–11. The hinge part 1' has once again two wall sections 2' and 3' which are arranged a distance apart and parallel to each other. The wall sections 2' and 3' are connected to each other on two adjacent enclosing ends of the hinge part 1' by wall sections 4' and 5', so that between these wall sections 2', 3', 4' and 5' is formed a space 6', into which can be accommodated a corner of the glass door 7. The fastening of the hinge part 1' on the glass door 7 is carried out once again by means of the grubscrew 12, which can be screwed into a tapped hole 11' in the wall section 2' and which presses the glass door 7 with its outside surface 13 against the inner section of the wall section 3'. A bead 14' is formed in the region of the wall section 5' on the outside surface of the wall section 3'. The bead 14', projects in the direction of the hinge swivelling axis and has a bore 15' on its end adjacent to the wall section 4' for the pivot axis or the hinge pin 16'. Hinge pin 16' has a head at one end. The hinge pin 16' is anchored either into the hole 15' and it can rotate in a hole 55 of the hinge arm 56. It is also possible to anchor the hinge pin 16' into the bore 55 with its end projecting beyond the upper face of the hinge arm 56 shown in FIG. 12 into the hole 15'.

Figure 12:
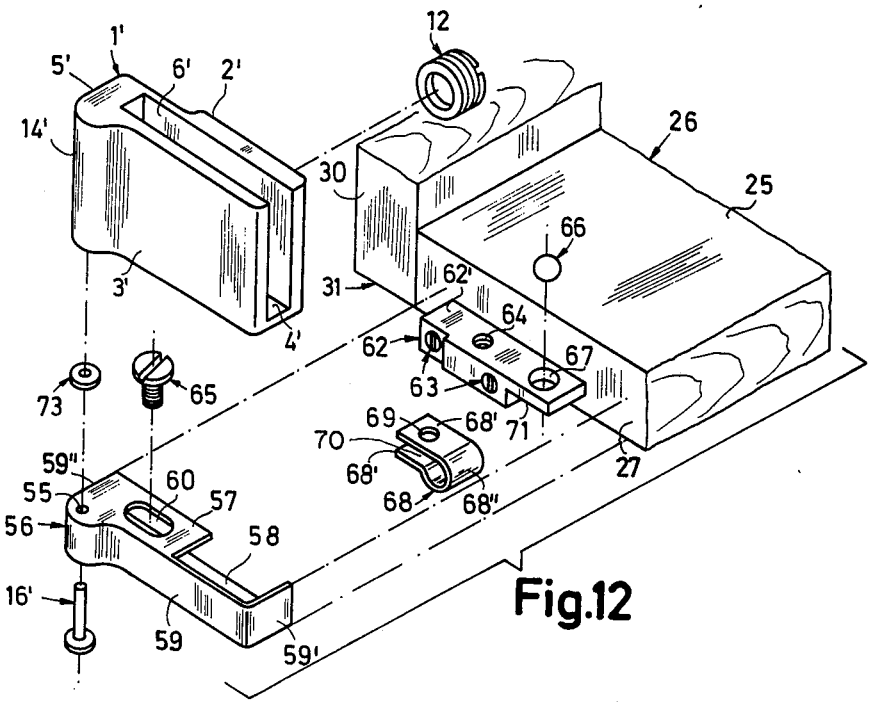
FIG. 12 is a perspective exploded view of the hinge part as well as of the hinge arm and the base or adjusting plate used for fastening this hinge arm together with a ratchet element of a second embodiment of the invention together with a partial view of a furniture item.
Figure 13:
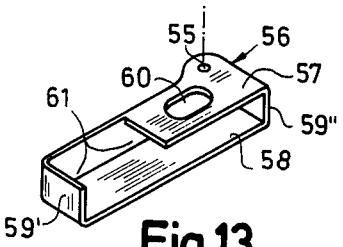
FIG. 13 is a perspective detailed view of the hinge arm of the hinge according to FIG. 12.
Figure 14:
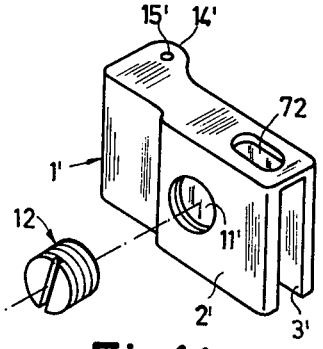
FIG. 14 is a perspective detailed view of the hinge part of the hinge according to FIG. 12, but viewed from the underside not visible in FIG. 12.
Figure 15:
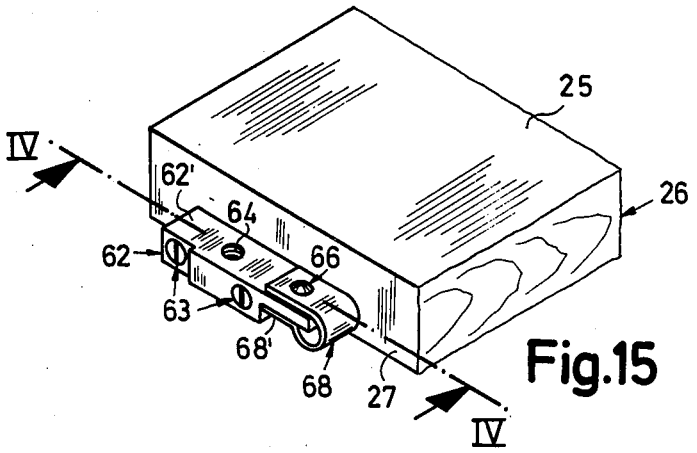
FIG. 15 is a perspective detailed view of the base or adjusting plate of the hinge according to FIG. 12 fastened front the front end face of the furniture floor.
Figure 16:
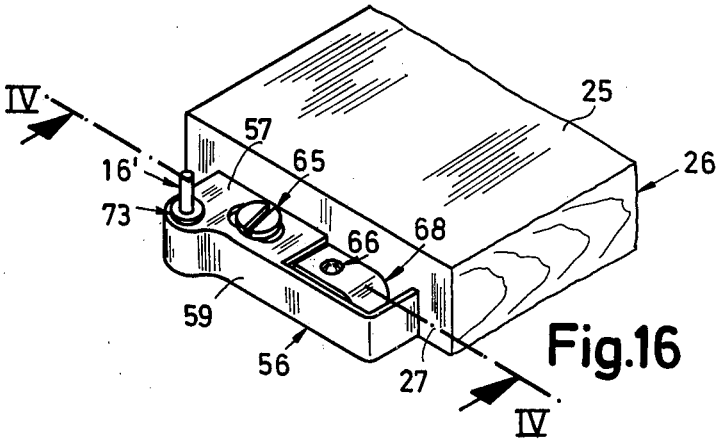
FIG. 16 is a view as in FIG. 15, with the hinge arm mounted on the base or adjusting plate.

The hinge arm 56 in this embodiment is as a U profile shaped component with two flanges 57 and 58 which are at right angles to the hinge swivel axis and at right angles to the hinge pin 16', of which the flange 57 forms the upper face of the hinge arm 56 shown in FIG. 12 and the flanges are connected together by a yoke 59 which projects along one longitudinal edge of the flanges 57 and 58 and which continues also in the region of both end edges of the hinge arm 56 in the form of sections 59' and 59'' in which the hole 55 is specified in the vicinity of the end with section 59'. As especially shown in FIGS. 12 and 13, the flange 57 has a slot 60 which projects in the direction of the longitudinal axis of the hinge arm 56. Moreover, the arm 57 is significantly shorter than the flange 58 so that an opening 61 remains on the visible top face of the hinge arm shown in FIG. 12 between the end facing away from the hole 55 of the flange 57 and the region or the section 59' of the yoke 59.

A square base or adjusting plate is provided for adjustably holding the hinge arm 56. The base or adjusting plate 62 is fastened on the edge 27 of a furniture part across the hinge swivelling axis, for example on the furniture floor 26. The base or adjusting plate 62 is fastened by screws 63, which engage the edge 27 through the holes of the base or adjusting plate 62. Both faces 62' of the base or adjusting plate 62 which project at right angles to the hinge swivel axis are spaced apart by a distance equal to or slightly smaller than the distance between the opposite inner faces of the flanges 57,58 so that the base or adjusting plate can be enclosed by the hinge arm 56 so that no rotation will take place. A tapped hole 64 is, moreover, provided in the longitudinal sides 62' for a fastening screw 65, which is used for holding the hinge arm 56 on the base or adjusting plate 62 and which passes through the slots 60, so that the hinge arm 56 can be adjusted in the direction at right angles to the hinge swivelling axis and in the direction parallel to the end face 27 of the furniture floor 26 to compensate for production tolerances or for tolerances in fitting the hinge on the furniture the direction parallel to the end face 27 of the furniture floor 26.

A ball 66 in a hole 67, at the end of the base or adjusting plate 62 remote from the bore 55 provides a ratchetting element, by means of which the glass door 7 is pressed at the end of the closing movement into its closed position and held there, so that the glass door 7 can be opened only after overcoming a force once again. The diameter of the hole 67 is equal to or slightly greater than the diameter of the ball 66, and the ball 66 is held in the hole 67 by a leaf spring 68. The leaf spring 68 has on both its ends, almost parallel flanges 68', which are connected to each other by rounded section 68''. Two aligned holes 69, and 70 are bored in flanges 68'. The hole 69 in the upper flange 68' of FIG. 12 has a greater cross section than the hole 70 in the other flange 68'. The diameters of both holes are smaller than the diameter of the ball 66. The ball 66 is first placed into the hole 67 and subsequently the leaf spring 68 is pushed with its arm 68' over the ball 66 until the ball 66 is gripped by the leaf spring 68 and part of its circumference the hole 69. The flange 68' provided with the hole 69 is situated on the visible upper longitudinal side 62' or an opening 71 is provided in the longitudinal side 62' of the base or adjusting plate for the ronded section 68'' in FIG. 12.

Figure 17:
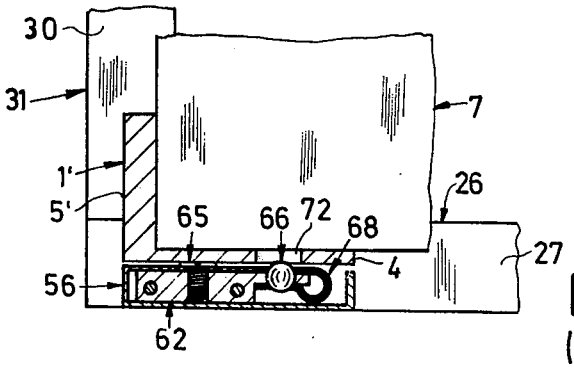
FIG. 17 is a cross section through the hinge part taken along IV—IV of FIGS. 12–16.
Figure 18:
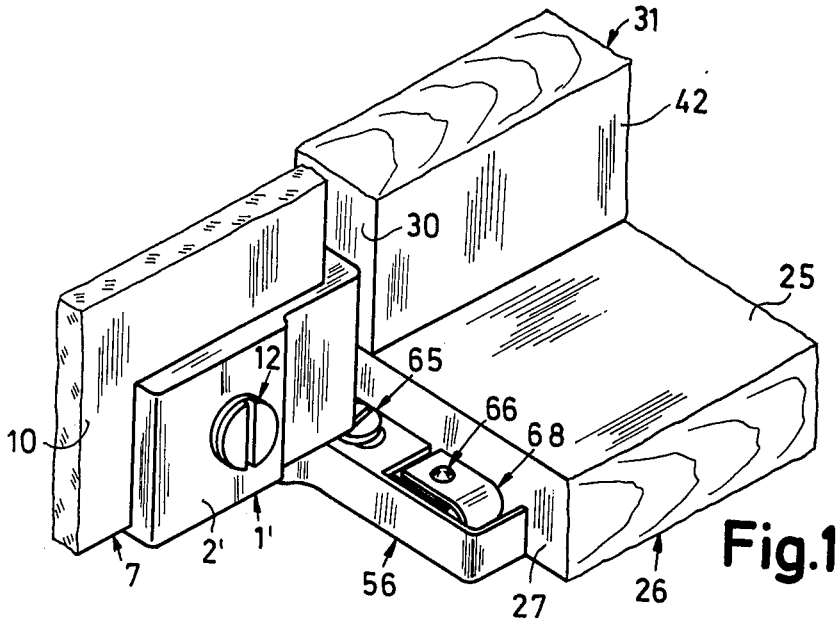
FIG. 18 is a perspective view of the hinge according to FIG. 12 fastened on the furniture and on the door, with the door open.
Figure 19:
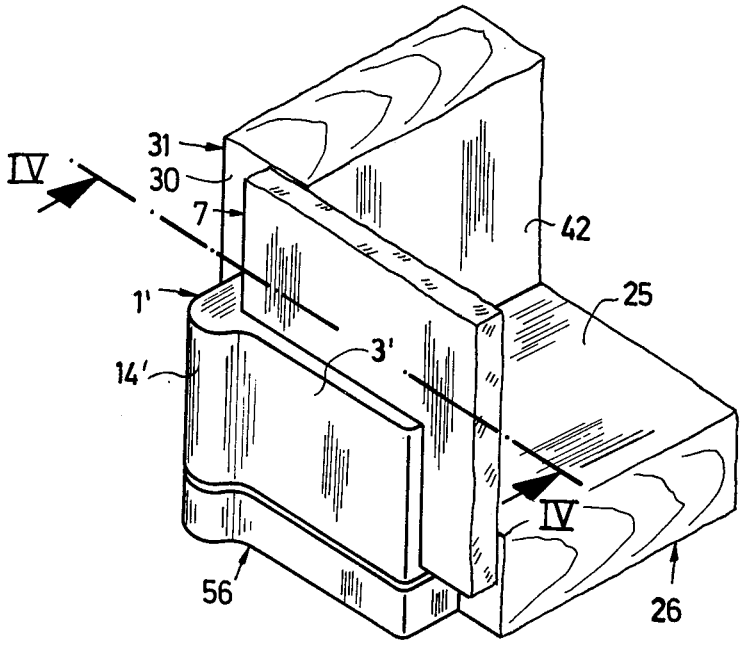
FIG. 19 is a view as in FIG. 18, with the door closed.

In the wall section 4' is provided a depression or (FIG. 17) slot 72, into which the ball 66 ratchets by the part of its circumferential surface which projects through the hole 69 when the glass door 7 is closed (cf. FIG. 17).

As shown by the above embodiments, this particular embodiment of the hinge according to the invention, has in addition to the high mechanical strength and compact design ensured by the U profile shaped design of the hinge arm 56, also an especially simple design of the ratchetting elements because the leaf spring 68 is used for holding the ball 66 and at the same time also for generating the spring force. In this embodiment also the ball 66 which is used as a ratchetting element is situated once again, when the glass door 7 is closed, closer to the inner space of the furniture than the hinge swivelling axis or closer than the pivot pin 16'.

In order to prevent contact between the outside surfaces of the wall section 4' (in FIG. 12 the bottom surface of this wall section) and the outside surface of the arm 57 or the head of the fastening screw 65, a washer 73 is arranged on the hinge pin 16', which is in contact with its surface against the arm 57 in the region of the hole 55 and which is in contact with its other top surface against the end of the bead 14' provided with the hole 15'.

Figure 23:
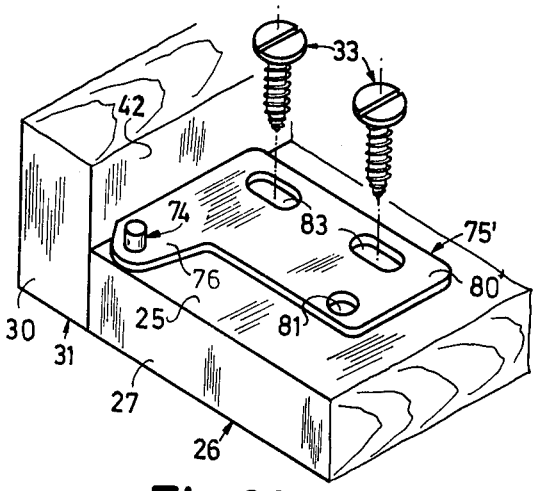
FIGS. 23, 24 and 25 show modified embodiments of the hinge arm for use with the hinge of FIG. 20.
Figure 24:
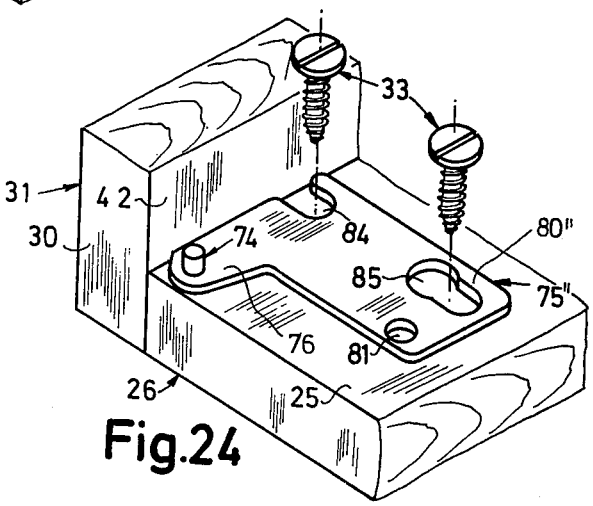

While the hinges shown in FIGS. 1–19 are used for connecting of "front contacting glass door", i.e. for hinging of glass doors which are held in the closed state against the end face of a furniture item and in this case especially also against the end faces 27 and 32 of the furniture floor 26 as well as on the furniture wall 31, the FIGS. 20–24 show glass door hinges for suspending and hinging of "sunk glass doors", i.e. for hinging of glass doors which are moved into the furniture opening in the closed state, which opening is, for example, bounded by the furniture side walls, furniture floor and furniture top. In this case the hinge part 1'' is used which, once again, is designed similar to the hinge part 1 and 1' with two wall sections 2'' and 3'' which run parallel to each other and are separated by a distance. Wall sections 2'' and 3'' accommodate between them, in the above described manner, a corner of the glass door 7 clamped by the grubscrew 12. In the region of the wall section 5'', which corresponds to the wall section 5 or 5' of FIGS. 1–19, a head 14'' is moulded on the outside surface of the wall section 3'' which projects in the direction of the hinge swivelling axis, whilst on the outside surface of the wall section 2'' a bead 17'' is provided, which is used, like the bead 17, in FIGS. 1–11 for accommodating the ratchetting element consisting of the bass 21, compression spring 22 and the grubscrew 20. In the region of the wall section 4'' the bead 14'' has the bearing hole 15'' for the hinge pin 74, which is provided on the hinge arm 75 (FIG. 20) or 15' or 75'' (FIGS. 23 or 24). The hinge pin 74 is fastened, if necessary, on a plate shaped projection 76 which contacts, by its one top surface end inner surface 25 of a furniture part which projects at right angles to the hinge swivel axis, for example the furniture floor 26 where the hinge pin 74 is situated in contrast to the hinges according to FIGS. 1–19 within the furniture in the direct vicinity of the edge 27.

Figure 20:
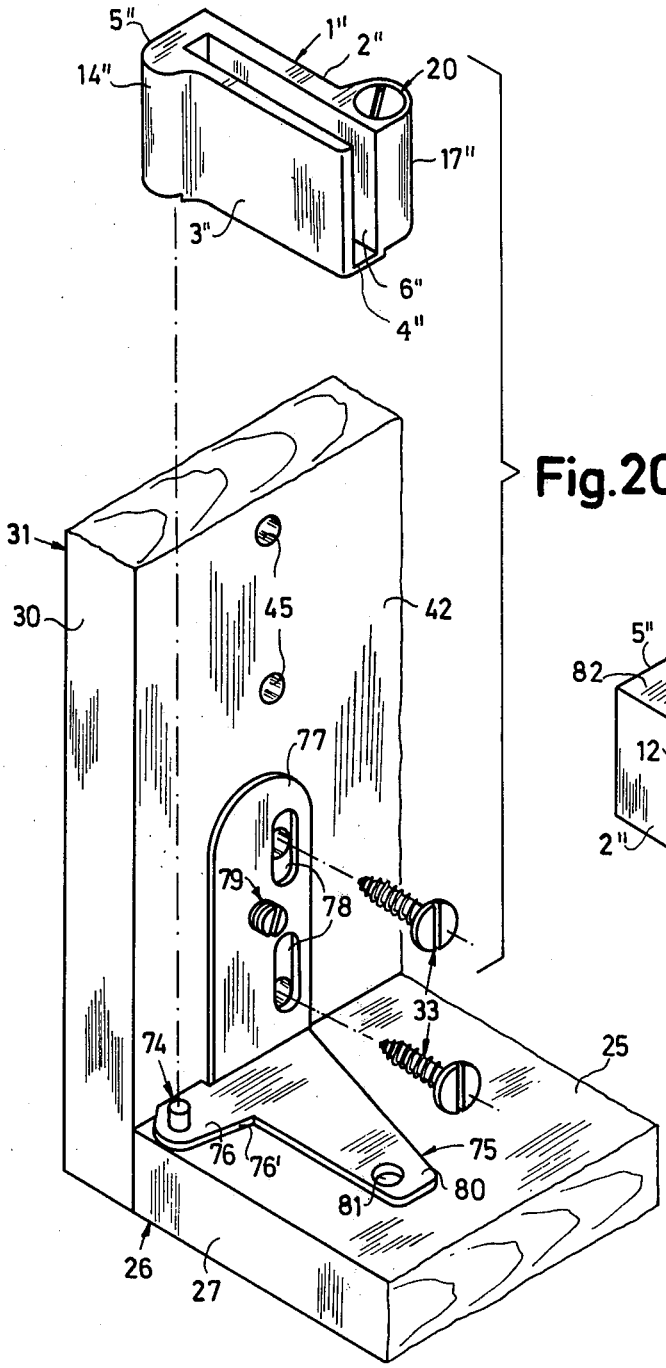
FIG. 20 is a perspective exploded view of a third embodiment of the hinge according to the invention together with a part view of the furniture.

A fastening bracket 77 is moulded within the furniture on the hinge arm 75 of FIG. 20. The fastening bracket 77 runs parallel to the inner surface 42 of the furniture side wall 31. The fastening bracket 77 has two slots 78 arranged in series in the direction of the hinge swivelling axis for the fastening screws 33, which are inserted into holes 45 of a row of holes and which make it possible to carry out adjustment of the hinge arm 75 in the direction at right angles to the inner surface 25 and in the direction of the hinge swivel axis. Alternatively slots 78 ensure fastening on the row of holes 45 with different hole spacing. In order to also provide adjustment of the hinge arm 75 in the direction at right angles to the hinge swivel axis and in the direction parallel to the inner face 25, there is provided an adjustment screw 79 on the fastening bracket 77. The adjustment screw 79 forms an adjustable contact face for the hinge arm 75 on the inner surface 42 of the furniture side wall 31.

Figure 21:
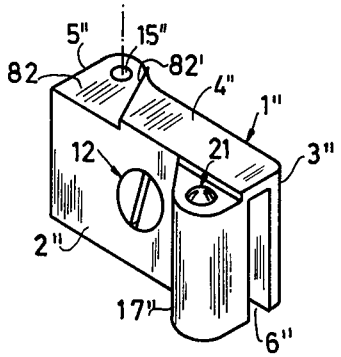
FIG. 21 is a hinge part of the hinge according to FIG. 20, viewed from the underside not visible in FIG. 20.
Figure 22:
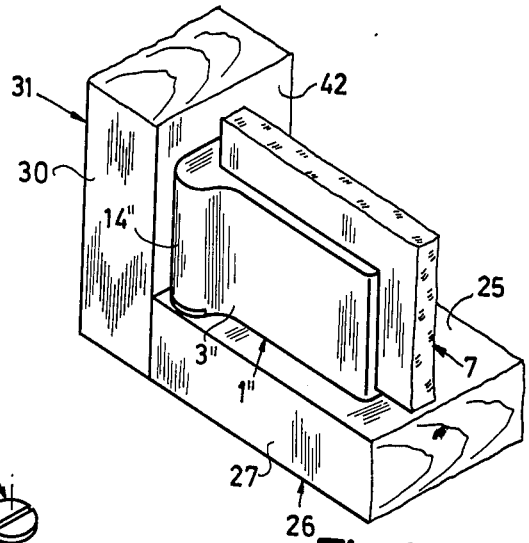
FIG. 22 is a perspective view of the hinge according to FIG. 20, with the door closed door, the hinge being fastened on the furniture as well as on the door.

In addition the projection 76 a projection 80 projects within the furniture in the direction of the end face 27 laterally away from the projection 76. The projection 80, in the same manner as the projection 76 and the fastening bracket 77, is plate shaped and one of its surfaces is in contact with the inner surface 25. The projection 80 has a hole 81 on its end, remote from the furniture side wall 31, which matches the hole 35 and into which the ball 21 ratches when the glass door 7 is closed. In order to form a stop for the closed glass door 7 an opening 87 in the region of the hole 15'' is provided in the outside surface of the wall section 4''. The edge 76' of projection 76, remote from the furniture side wall 31, rests against the edge 82' of opening 82 which is remote from the wall section 5''. In addition, the bead 17'', as shown especially in FIG. 21, is short enough to establish a space between the outside surface of the wall section 4'' and the end of the bead 17. This space corresponds approximately to the thickness of the projection 80, so that by this means an additional contact surface is produced for the hinge arm 1'' on the hinge arm 75 when the glass door 7 is closed.

The hinge arms 75' and 75'', which can also be used together with a hinge part 1'', differ in their design basically from the hinge arm 75 only by the fact that the fastening bracket 77 is eliminated and the projection 80' or 80'', which is in contact with the inner surface 25, has two holes 83 or 84 and 85 for two fastening screws 33, which engage with the furniture part at right angles to the hinge swivelling axis, for example with the furniture floor 26. The two openings 83 in the form of slots are aligned in the embodiment according to FIG. 23 in the direction at right angles to the inner surface 42 of the furniture side wall 31 behind each other, so that here also it is possible to adjust the hinge arm 75' in this direction or in a direction at right angles to the hinge swivelling axis and parallel to the edge 27. In the embodiment shown in FIG. 24 the opening 84 is a sidways open slit and the opening 85 is designed as a keyhole type opening, whose advantage is that the fastening screws 33 can be preassembled, in which the hinge arm 75'' is then mounted on the preassembled fastening screw 33 or it can be pushed sideways under the head of these fastening screws 33.

Figure 25:
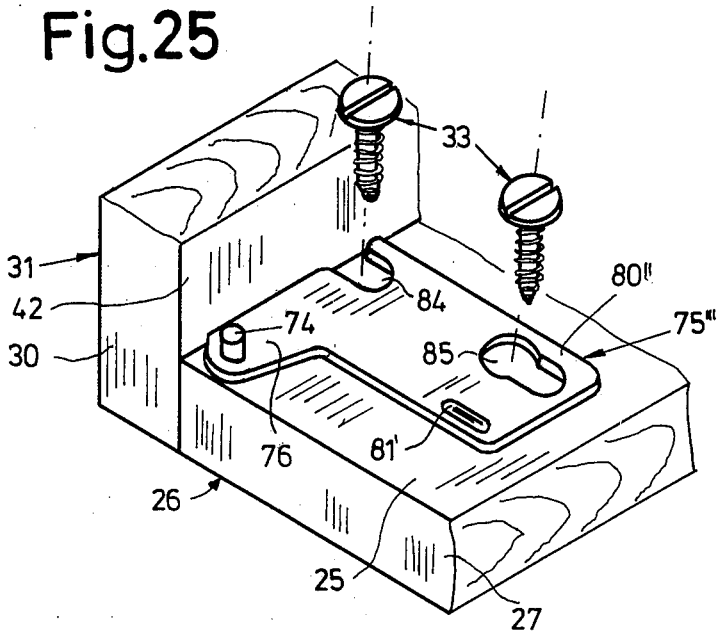

FIG. 25 shows another embodiment of a hinge arm 75''', which can also be used in conjunction with the hinge part 1''. The hinge arm 75''' differs from the hinge arm 75'' of FIG. 24 basically by the fact that instead of the hole 81, a bead or a groove 81' is provided, one or several of which form, by their sides facing away from the edge 27 of the furniture floor, the ratchetting surfaces and behind which the ball 21 ratchets into position on closing the glass door 7. The bead or the groove 81' projects for this purpose beyond the surface of the hinge arm 75' which faces away from the furniture floor 26 and it projects across or at right angles to that path which the ball 21 covers on opening and closing of the glass door 7 or on swivelling the glass door about the hinge pin 74. In the simplest case the groove 81 is formed by pressing out or by deforming the material of the plate shaped arm 75'''. The groove 81' is situated in this case, in the same manner as the hole 81, in the direct vicinity of the edge of the hinge arm 75''' in the direct vicinity of the edge 27, and especially outside the projection 76.

The components of the hinges described in FIGS. 1–24 consist preferably of metal, in which the hinge parts 1,1' and 1'' are made for example as pressure die cast metal components, while the hinge arms 23,23', 23'' and 23''' as well as the hinge arms 75, 75' and 75'' are made as sheet metal components by a pressing and bending process. The hinge arm 56 consists also preferably of sheet metal and it is made for example by a deep drawing process. It is of course also possible to make hinge arms 56 by a pressing or bending process and subsequently the arms 57 and 58 can be connected to the suction 59' and 59'' for example by welding.

The base or adjusting plates 51 and 62 consist for example of metal or also of tough plastics material.

The invention was explained above by embodiment examples. It is understood that variations of the above are also possible without departing from the basic idea of the invention.

What we claim as our invention is:

1. A hinge for pivoting and guiding a door on furniture comprising:

a hinge arm for attachment to said furniture and a hinge member for attachment to said door and being pivotally connected to the hinge arm by at least one pivot pin, said hinge member being formed by a U-profile having two flanges with one of said flanges being positioned on the door outside face and visible when the door is closed and the other of said flanges being positioned on the door inside face and being behind the door when the door is closed, a yoke connecting said flanges to each other and abutting a side face of the door, said two flanges of said U-profile, which encloses the door in form of a clamp, being connected to each other additionally by wall means at right angles to said flanges and said yoke, said hinge member having a first surface which is adjacent to a second surface on the hinge arm in the door closed position, one of these surfaces being provided with a ratchet surface and the other of these surfaces being provided with a spring-loaded ratchetting element which snap fits behind said ratchet surface.

2. A hinge according to claim 1, wherein the ratchet surface is formed by the edge of a depression

3. A hinge according to claim 1, wherein the ratchet surface is formed by a bead on one of the surfaces.

4. A hinge according to claim 1, wherein said spring loaded ratchetting element is a ball loaded by a spring, said ball being operative to snap fit behind said ratchet surface when the door is closed and wherein said other of said flanges of said U-profile includes a bead which extends in the direction of the axis of said pivot pin and a hole adapted for accommodating said ball.

5. A hinge according to claim 1, wherein both the ratchetting element and the ratchet surface are situated behind the outer surface of the door when the door is closed.

6. A hinge according to claim 1, wherein the hinge arm and the hinge member are pivotally connected to each other by at least one pivot axis, said pivot axis being situated near the outer surface of said one of said flanges forming the U-profile of said hinge member.

7. A hinge according to claim 1, wherein the hinge arm and the hinge member are pivotally connected to each other by means of at least one pivot axis and wherein the ratchetting element is situated in relation to said pivot axis displaced relative to the middle of the door.

8. A hinge according to claim 1, wherein the hinge member includes abutment means on said hinge arm and has projections on the outside surface of the other of said first and second flanges, which, when the door is closed, are in contact with said abutment means on the hinge arm.

9. A hinge according to claim 1, wherein the hinge member includes openings on said hinge arm and has projections on the outside surface of the other of said first and second flanges, which, when the door is closed move into said openings on the hinge arm.

10. A hinge according to claim 1, wherein the hinge arm is a plate-like member and has a first section by means of which the hinge arm can be fastened on the inside of said furniture, and wherein said first section of said hinge arm includes said ratchet surface.

11. A hinge according to claim 10, wherein the hinge arm has a second section, which projects through a gap between said door and the furniture body to the front side of said door when the door is closed and said second section supports the pivot axis.

12. A hinge according to claim 11, wherein said second section includes first and second bent part sections for suspending a front-contacting door, said first bent part section running parallel to the pivot axis of the hinge, and said second bent part section running at right angles to the first part section, said second part section being effective for supporting the pivot axis.

13. A hinge according to claim 12, wherein the first section of the hinge arm is provided with a bent angle or lug, adapted for fastening the hinge arm on the inner surface of a furniture side wall, and including a first adjusting screw on the first section and a second adjusting screw on the bent angle for adjusting the hinge arm in the direction of the pivot axis as well as in a direction at right angles to said pivot axis.

14. A hinge according to claim 11 for pivoting a sunk door, wherein the second section of the hinge arm is situated parallel to the inner surface of the furniture at right angles to the pivot axis and it has the pivot axis on its end, situated inside the furniture member.

15. A hinge according to claim 10, further comprising an adjusting plate adapted to be fastened to the furniture, means on the hinge arm for adjustably fastening said hinge arm on said adjusting plate, and said means being a U-shaped section of the hinge arm embracing said adjusting plate.

16. A hinge according to claim 15, wherein the adjusting plate is adapted to be fastened on an inner surface of the furniture which surface runs at right angles to the pivot axis of the hinge.

17. A hinge according to claim 15, wherein the adjusting plate is adapted to be fastened on an edge of the furniture, which edge runs at right angles to the pivot axis.

18. A hinge according to claim 1, further comprising an adjusting plate adapted to be fastened to said furniture and means for fastening said hinge arm on said adjusting plate, wherein the adjusting plate has a hole for a ball used as said ratchetting element, and wherein the ball projects with part of its circumferential enclosing surface from at least one end of said hole, wherein a curved leaf spring is provided having two flanges thereon, said two flanges enclosing the adjusting plate in the region of said hole, and wherein at least one flange of the leaf spring has a hole, through which a part of the enclosing surface of the ball projects.

19. A hinge according to claim 18, wherein the leaf spring is in contact, by its flange provided with said hole, with a top surface of the adjusting plate.

20. A hinge according to claim 18 or 19, wherein the second flange of the leaf spring is provided with a hole whose diameter is smaller than the diameter of the ball.

21. A hinge according to claim 1, wherein the first and second surfaces are disposed at right angle to the hinge pivot axis.

22. A hinge according to claim 1, wherein said at least one pivot pin which connects the hinge member to the hinge arm, is operative to place said first and second surfaces in face to face relationship when said door is in its closed position.

23. A hinge for pivoting and guiding a door on furniture comprising:

a hinge arm for attachment to said furniture and a hinge member for attachment to said door and being pivotally connected to the hinge arm by at least one pivot pin, said hinge member being formed by a U-profile having two flanges with one of said flanges being positioned on the door outside face and visible when the door is closed and the other of said flanges being positioned on the door inside face and being behind the door when the door is closed.

a yoke connecting said flanges to each other and abutting a side face of the door, said two flanges of said U-profile, which encloses the door in form of a clamp, being connected to each other additionally by wall means at right angles to said flanges and said yoke, said hinge member having a first surface which is adjacent to a second surface of the hinge arm in the door closed position, one of these surfaces being provided with a ratchet surface and the other of these surfaces being provided with a resiliently urged ratchetting element which snap fits behind said ratchet surface.

24. A hinge according to claim 18, wherein said wall means of the U-profile, which wall means connects the two flanges, forms said one surface provided with said ratchet surface, and wherein said adjusting plate is adjacent said wall means in the hinge closed position.

* * * * *